US006827758B2

(12) United States Patent
Takaya et al.

(10) Patent No.: US 6,827,758 B2
(45) Date of Patent: Dec. 7, 2004

(54) METHOD FOR MANUFACTURING MAGNETIC METAL POWDER, AND MAGNETIC METAL POWDER

(75) Inventors: Minoru Takaya, Tokyo (JP); Yoshiaki Akachi, Tokyo (JP); Hisashi Kobuke, Tokyo (JP); Hiroyuki Uematsu, Tokyo (JP)

(73) Assignee: TDK Corporation, Tokyo (JP)

( * ) Notice: Subject to any disclaimer, the term of this patent is extended or adjusted under 35 U.S.C. 154(b) by 0 days.

(21) Appl. No.: 10/159,953

(22) Filed: May 29, 2002

(65) Prior Publication Data

US 2002/0189401 A1 Dec. 19, 2002

(30) Foreign Application Priority Data

May 30, 2001 (JP) ..... 2001-163523

(51) Int. Cl.[7] ..... B22F 9/30
(52) U.S. Cl. ..... 75/348; 75/349; 148/105
(58) Field of Search ..... 148/105; 75/348, 75/349

(56) References Cited

U.S. PATENT DOCUMENTS

| | | | | |
|---|---|---|---|---|
| 3,855,016 A | * | 12/1974 | Ehrreich et al. | 148/105 |
| 4,390,361 A | * | 6/1983 | Sueyoshi et al. | 148/105 |
| 4,464,196 A | * | 8/1984 | French | 148/105 |
| 4,927,456 A | * | 5/1990 | Kopatz et al. | 75/346 |
| 5,470,374 A | * | 11/1995 | Nakamura et al. | 75/348 |

FOREIGN PATENT DOCUMENTS

| | | |
|---|---|---|
| EP | 1 059 134 | 12/2000 |
| JP | 50-137856 | 11/1975 |
| JP | 54-120640 | 9/1979 |
| JP | 60-16041 | 4/1985 |
| JP | 62-001807 | 1/1987 |
| JP | 62-023901 | 1/1987 |
| JP | 63-131405 | 6/1988 |
| JP | 63-307201 | 12/1988 |
| JP | 01-247503 | 10/1989 |
| JP | 01-286919 | 11/1989 |
| JP | 02-194137 | 7/1990 |
| JP | 02-196023 | 8/1990 |
| JP | 04-043504 | 2/1992 |
| JP | 05-140620 | 6/1993 |
| JP | 05-310425 | 11/1993 |
| JP | 06-081012 | 3/1994 |
| JP | 06-228604 | 8/1994 |
| JP | 06-279816 | 10/1994 |
| JP | 07-233460 | 9/1995 |
| JP | 08-092613 | 4/1996 |
| JP | 08-170112 | 7/1996 |
| JP | 08-246010 | 9/1996 |

(List continued on next page.)

OTHER PUBLICATIONS

Yoshida, et al., "Preparation of Ultrafine Iron Particles Using an FR Plasma", Institute of Electrical Engineers, Transactions of the Japan Institute of Metals, Jun. 1981, vol. 22, No. 6, pp. 371–378.

*Primary Examiner*—George Wyszomierski
(74) *Attorney, Agent, or Firm*—Hogan & Hartson, LLP

(57) ABSTRACT

A method for manufacturing magnetic metal powder is provided. In the method, a powdered magnetic metal oxide is supplied to a heat treatment furnace with a carrier gas composed of a reducing gas. The heat treatment furnace is maintained at temperatures above a reducing action starting temperature for the powdered magnetic metal oxide and above a melting point of the magnetic metal in the powder. The powdered magnetic metal oxide is subject to a reducing process, and then magnetic metal particles, the resultant reduced product, is melted to form a melt. The melt is re-crystallized in a succeeding cooling step, to obtain single crystal magnetic metal power in substantially spherical form.

29 Claims, 11 Drawing Sheets

FOREIGN PATENT DOCUMENTS

| | | |
|---|---|---|
| JP | 08-319116 | 12/1996 |
| JP | 10-102108 | 4/1998 |
| JP | 10-280013 | 10/1998 |
| JP | 10-324906 | 12/1998 |
| JP | 10-330802 | 12/1998 |
| JP | 11-021603 | 1/1999 |
| JP | 11-080818 | 3/1999 |
| JP | 11-124602 | 5/1999 |
| JP | 2000-038602 | 2/2000 |
| JP | 2000-063901 | 2/2000 |
| JP | 2000-178602 | 6/2000 |
| JP | 2000-309802 | 11/2000 |
| JP | 2002-020809 | 1/2002 |

* cited by examiner

METHOD FOR MANUFACTURING MAGNETIC METAL POWDER, AND MAGNETIC METAL POWDER

BACKGROUND OF THE INVENTION

1. Field of the Invention

The present invention relates to magnetic metal powder and its manufacturing method.

2. Description of Related Art

The manufacturing method of metal powder can be classified by its starting raw material. In other words, metal powder can be manufactured from its gaseous phase, liquid phase and solid phase. And, as a specific method for manufacturing metal powder from the gaseous phase, the known methods are a chemical vapor deposition (CVD) method, sputtering method and vacuum deposition method. As for methods of manufacturing metal powder from the liquid phase, the known methods are a co-precipitation method, gas or water atomization method, spray method and spray pyrolysis method. As for making metal powder from solid phase, there is a pulverizing method that uses a crusher to pulverize metal nuggets into particles of appropriate sizes or administering a prescribed process on the pulverized powder.

Various parts used in the electronics field will be more frequently and widely used in the high frequency range. The same can be said about printed circuit boards. Substrates with various characteristics will be in demand such as those with high or low dielectric constant, high magnetic characteristics or those that absorb radio waves. To obtain these substrates, magnetic powder with excellent high frequency characteristics are being mixed and dispersed into printed circuit boards according to its needs. Some of the magnetic powders being used are ferrite powder and carbonyl iron powder for high frequency use. In areas other than printed circuit boards, there is the packaging category where radio wave absorbing powders are mixed and dispersed within resin. In the field of conductive pastes, conductive particles are mixed and dispersed in thick film pastes to manufacture electronic circuits, resistors, capacitors and IC packages. Moreover, in soft magnetic materials, magnetic powder is used widely for making coil materials for power supplies like choking coils. As for magnetic materials, there are core materials for motors. Magnetic powder is also used in magnetic resistors and magnetic sensors.

A technique for creating metal powder for thick film paste using the spray pyrolysis method is known. This technique entails spraying a solution containing metal salts to create liquid droplets, and heating the droplets at a temperature higher than the metal salt decomposition temperature and at a temperature higher than the metal melting point, but if the metal forms an oxide at temperature below its melting point, at a temperature higher than the oxide decomposition temperature, in order to thermally dissolve the metal salt and melt the metal particles thus created.

According to the spray pyrolysis method, the metal powder thus obtained is spherical with excellent crystallization properties and with high dispersant characteristics. According to the spray pyrolysis method, for example, Ag powder can be formed with the maximum particle size of 1.7 $\mu$m and the minimum particle size of 0.5 $\mu$m using a solution containing $AgNO_3$; Ag—Pd alloy powder is formed with particle sizes ranging from 2.5 $\mu$m (max) to 1.5 $\mu$m (min) by using a solution containing $AgNO_3$ and Pd $(NO_3)_2$, and Au powder is formed with particle sizes ranging from 1.0 $\mu$m (max) to 0.5 $\mu$m (min) using a solution containing $HAuCl_4$. Also, these powders are said to have excellent crystalline characteristics.

In this manner, metal powder with particle sizes ranging from 0.5 to 2.5 $\mu$m and excellent crystalline characteristics can be obtained. Metal powder with these properties is suitable as conductive paste.

However, the examples described above pertain to Ag, Ag—Pd alloy and Au, but not to metal powder, especially Fe powder, that is suitable for using the mixing and dispersing of magnetic powder.

Prior art teaches methods of manufacturing metal powder by the spray pyrolysis method, and suggests the possibility of manufacturing Fe powder or Fe alloy powder. However, we have not as yet seen an example of actually manufacturing Fe powder or Fe alloy powder. In other words, it can be said that metal powder that can be manufactured by the spray pyrolysis method had imposed considerable restrictions on the types of metal powder.

It is noted that Fe powder or Fe alloy powder can be manufactured from gaseous phase and solid phase as explained above. However, the particle size of metal particles formed by the gaseous phase manufacturing method is very small, and thus, unsuitable to be mixed with resin. Also, metal powder formed from the solid phase manufacturing method has poor particle distribution and the shape of the powder particles is not spherical because crushing machines are used.

Thus, magnetic metal powder, especially Fe or Fe alloy powder with properties suitable to be mixed with resin were unavailable from conventional metal powder manufacturing methods.

SUMMARY OF THE INVENTION

The present invention relates to a manufacturing method to obtain magnetic metal powder with properties suitable to be mixed with resin, and to provide novel magnetic metal powder that was previously unavailable.

In order to solve the problems described above, the inventors of the present invention studied the causes that restricted the types of metal powder that could be produced under the spray pyrolysis method. The spray pyrolysis method uses liquid solutions as raw material, and consumes thermal energy for pyrolyzing water unrelated to the target metal sought during the high temperature processing step. Also, because water vapor is generated, the environment for performing the thermal pyrolysis, or typically, the reducing process, becomes a vaporous atmosphere. The moisture in the water vapor atmosphere diminishes the reducing operation. Therefore, depending on some of the conventional spray pyrolysis methods, it is believed that metal powder that uses starting material requiring strong reduction could not be obtained. The Ag, Ag—Pd alloy and Au noted above can be obtained without requiring a strong reducing power.

The inventors were successful in manufacturing spherical-shaped single crystal Fe powder, which was unobtainable under conventional methods, by conducting a heat treatment on dry compound powder with specified particle sizes, as the starting raw material, without using the wet starting material as in the case of the spray pyrolysis method.

In accordance with one embodiment of the present invention, a method for manufacturing magnetic metal powder includes a raw material supply step to supply raw powder for forming magnetic metal through pyrolysis with a carrier gas to a predetermined heat processing region, a heat treatment step for heating the raw powder at a temperature higher than the thermal decomposition temperature of the raw powder, and a cooling step in which a product obtained from pyrolysis is cooled to provide magnetic metal powder including the magnetic metal element.

In addition to the merit that spherical-shaped single crystal Fe powder, unobtainable under conventional methods, can be obtained under the present invention, the method requires less heating energy than that of conventional spray pyrolysis methods because the heat treatment is implemented on dry compound powder, and there is the additional benefit of a high recovery rate.

The magnetic metal powder obtained in accordance with the present invention is not limited to a single crystal form of Fe, but also allows the manufacturing of other magnetic metal powder. As for the magnetic properties, the present invention can be used to make soft magnetic materials as well as hard materials.

In accordance with the present invention, the carrier gas includes a reducing gas, and a magnetic metal powder can be obtained by reducing the raw powder in the heat treatment step with the reducing gas, and cooling down the reduced substance.

In accordance with the present invention, it is also possible to obtain a magnetic metal powder by first creating a melt from the reduced substance in the heat processing step and by re-crystallizing the melt at the cooling process step.

Moreover, the present invention allows reducing the melt created after melting the raw powder at the heat processing step, and obtaining a magnetic metal powder by re-crystallizing the reduced melt in the cooling process step. In other words, the present invention offers the option of using a method to form a melt of the raw powder and cool and solidify the melt, after reducing the raw powder in solid form, or a method to melt the raw powder in solid form into a molten state and reduce the melt while retaining the same in its molten state, and then cool the melt. In this manner, by melting the raw powder once, the magnetic metal powder to be obtained can be readily changed into single crystal form.

In present invention, a magnetic powder of pure iron may be obtained by using an iron oxide powder as the raw powder.

Also, in the process of manufacturing the magnetic powder, the present invention allows the formation of a coating layer on the surface of the magnetic powder. To form the coating layer, the raw powder and a powder formed from a compound consisting of at least one element as its ingredient with a reducing power stronger than that of the magnetic metal included in the raw powder may be supplied to the heat treatment region. In this case, the powder formed from a compound consisting of at least one element as its ingredient with a reducing power stronger than that of the magnetic material may preferably have particle sizes smaller than those of the raw powder. Also, the raw powder may contain a compound consisting of at least one element as its ingredient with a stronger reducing power than that of the magnetic metal, with the result that a coating can be formed on the surface of the magnetic powder during the process of manufacturing the magnetic powder. Methods of forming the coating layer shall be explained later.

As explained above, the present invention provides Fe powder or Fe alloy powder with properties unavailable under conventional methods. That is, the present invention concerns a method comprising the steps of supplying a powdered oxide of at least one type selected from Fe group elements with a mean particle size of about 0.1–100 $\mu$m in a heat treatment atmosphere, forming a melt of the powdered oxide in the heat treatment atmosphere, and cooling and solidifying the melt to form magnetic metal powder composed of at least one type of Fe group elements. In the manufacturing method, a reducing step may be conducted in the heat treatment atmosphere before the melt is formed, or after the melt is formed but before it is cooled and solidified.

The magnetic metal powder of the present invention may have a mean particle size in the range of about 0.1–20 $\mu$m. The mean particle size may preferably be from about 0.5 to 10 $\mu$m, or more preferably from about 1 to 5 $\mu$m. Moreover, excellent magnetic characteristics and high frequency characteristics can be obtained because the magnetic metal powder to be obtained by the present invention can be formed into a single crystal form.

In the method of manufacturing magnetic metal powder described above, it is possible to form a coated layer during its manufacturing process.

The powder obtained by the process of the present invention is a single crystal powder composed of Fe as a main ingredient. The powder obtained by the process of the present invention is novel magnetic metal material in a spherical form with a mean particle size ranging from about 0.1 to 20 $\mu$m, which was unobtainable under conventional methods. A preferred mean particle size in the magnetic metal powder obtained by the present invention may range from about 0.5 to 10 $\mu$m, and more preferably about 1 to 5 $\mu$m. Also, the magnetic metal powder obtained from the present invention offers an excellent magnetic characteristic of more than 2.0 T in saturated magnetic flux density.

While the magnetic metal powder of the present invention can be formed only from the metal, it is also possible to form a coating layer on the surface of the magnetic metal powder. While the coating layer can be formed after the magnetic metal powder is made, it can also be formed during the manufacturing process of the magnetic metal powder as explained above. In this case, the coating layer can be formed by a compound made of at least one element as its ingredient with a greater affinity to oxygen than that of Fe. By forming a coating layer, it is possible to add acid-resistant, insulation and non-cohesion properties to the magnetic metal powder.

Other features and advantages of the invention will be apparent from the following detailed description, taken in conjunction with the accompanying drawings that illustrate, by way of example, various features of embodiments of the invention.

EMBODIMENTS OF THE PRESENT INVENTION

Embodiments of the present invention will be described below.

Figure 1:
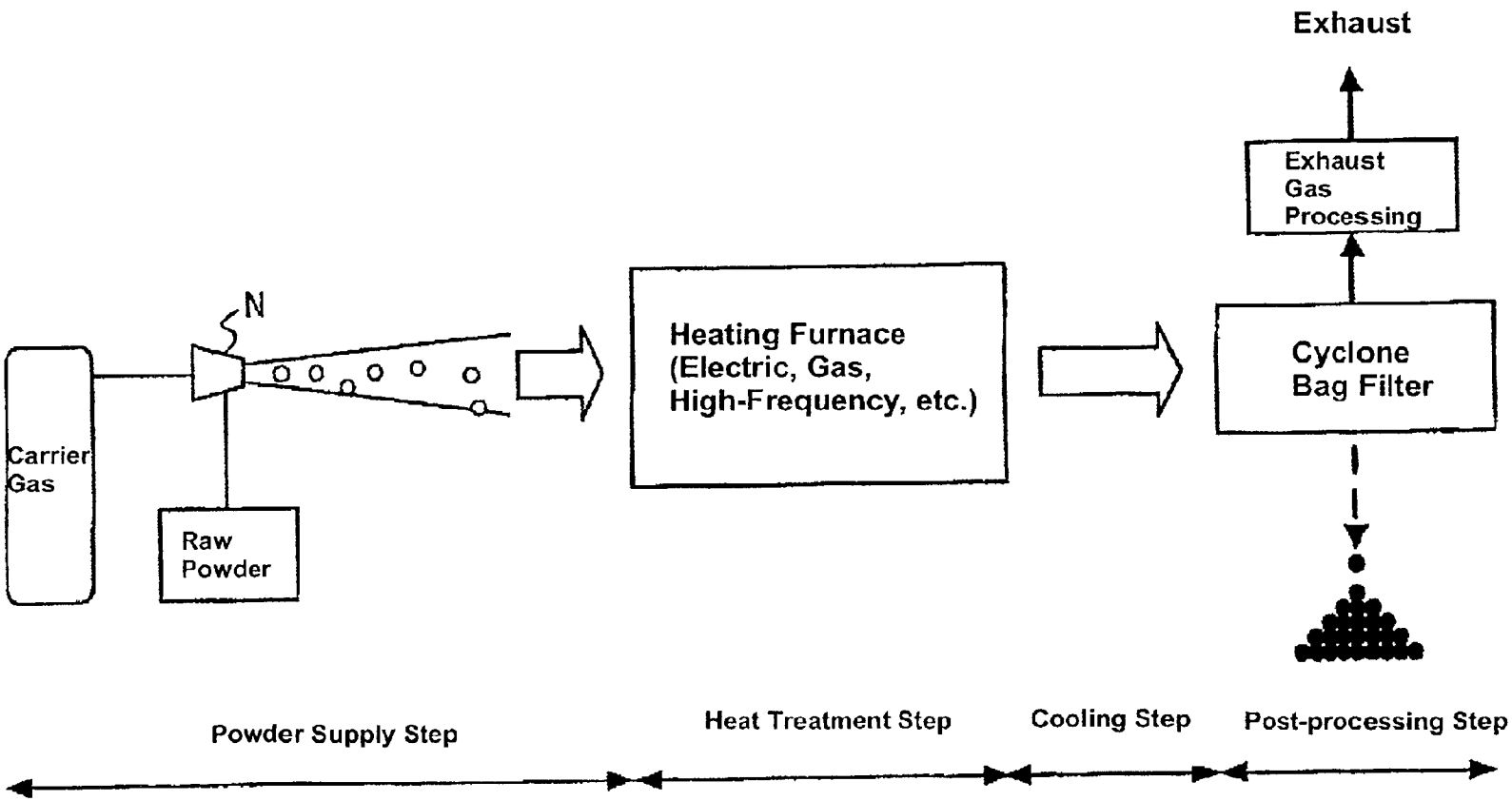
FIG. 1 shows an example of a process for manufacturing magnetic metal powder in accordance with one embodiment of the present invention.

First, the outline of the manufacturing process for magnetic metal powder will be explained on the basis of FIG. 1. As shown in FIG. 1, the manufacturing method in accordance with an embodiment of the present invention includes a powder supplying step for supplying a raw material powder, a heat treatment step in which the supplied powder is heated at a predetermined temperature to form a product, and a cooling step in which the product obtained in the heat treatment step is cooled. In addition, a post-processing step may be conducted.

FIG. 1 shows an example to realize a powder supplying stage, in which a carrier gas and raw material powder are prepared separately. The raw material powder is sent to a heat treatment stage together with the carrier gas via a nozzle N. Gas that can form a reducing atmosphere can be used in the heat treatment stage as the carrier gas. For example, such known gas with reducing capability as hydrogen, carbon monoxide and ammonia gas may be used. Within this group, it is desirable to use hydrogen gas that increases its reducing power at high temperatures. Also, the reducing gas may be supplied as a mixture with inert gas. The inert gas to be mixed may be nitrogen gas, Ar gas and Ne gas. When considering the emission of NOx at the heat treatment stage, it is preferred that Ar gas or Ne gas or both may be used. Moreover, an inert gas may be used as the carrier gas, and a reducing gas may be supplied in the region where a reducing atmosphere is formed. This can be applied for the reducing process for a melt when the raw material powder is melted.

The reducing efficiency is dependant on the thermal pyrolysis temperature of the raw powder, its size, the quantity of the powder per unit volume, carrier gas speed (the amount of time the powder stays in the reducing temperature) within the pyrolysis environment and pressure. When reducing efficiency is considered, the higher the pressure the better the reducing condition becomes. However, in view of collecting the powder, it is preferable to apply a negative pressure such that the powder is formed under conditions closer to the atmospheric pressure. The density of reducing gas in the carrier gas can be appropriately set by the affinity of the raw material powder, its shape, size and the speed (the amount of time the powder stays in the reducing temperature) within the reducing area, the volume of the powder per unit volume against the carrier gas, the reducing reaction constant of the element being reduced against the reducing agent and pressure. Degrees (higher or lower) of reducing power between the two types of elements would appear as a difference in the strength of the so-called affinity to the elements subjected to the reduction, and it is a difference in the standard free energy change that occurs when there is a reaction between the reducing agent and the compound of the target metal. The magnitude of the difference determines whether or not a reduction takes place.

The method for supplying raw powder to the heat treatment process stage is not limited to the method described with reference to FIG. 1. For example, it is possible to adopt a method to supply the raw powder to the heat treatment stage with the carrier gas by blowing compressed gas containing the reducing gas against the raw powder. It is also possible to feed the raw powder by using the dispersion equipment, or the output of the classification equipment or crusher equipment. In other words, the powder may be send to the heat treatment stage from the discharging side of the classifying machine or the crushing machine.

The heat treatment process is conducted in a heating furnace. For the heating method, the available known method such as heating with electricity, the combustion heat from gas or heating by high frequency heating may be used. The raw powder in a suspended state or in a floating state in the heating furnace together with the carrier gas is thermally decomposed, in other words, reduced. A more concrete description of the reduction will be explained later. The flow speed of the raw powder during pyrolysis is determined by the reducing gas temperature, collection efficiency and thermal pyrolysis temperature. The flow speed may be selected in a range between about 0.05 and 10 m/s, preferably in a range between about 0.1 and 5 m/s, and more preferably between about 0.5 and 2 m/s. The flow speed of the powder can be changed by controlling the flow speed of the carrier gas.

The product obtained from the heat treatment process is moved to the cooling step. For example, a cooling zone may be provided within the heating furnace to cool the product in the cooling zone, or the product may be cooled by discharging it with the carrier gas into the atmosphere. The cooling may be done by leaving the powder out in the atmosphere or forcefully cooling it with a cooling medium. Desired magnetic metal powder is obtained by having the powder go though the cooling step.

After the cooling process, the powder is collected by using a cyclone bag filter. The carrier gas is disposed of after the proper exhaust gas process has been performed.

The raw powder in the present embodiment incorporates metal elements that possess magnetic characteristics. While its types are not limited, they are transition metals containing Fe, notably comprising mainly of the Fe Group elements (Fe, Ni, Co), and may include other semimetal elements (Si, P, etc.) and other transition metal elements (Mn, Cu, Cr, etc.)

The shape of the raw powder is not restricted as long as they are able to create the prescribed metal powder (including alloys) through pyrolysis. For example, it can be compounds, such as oxides, nitrides, borides or sulfides of magnetic metal, metal salts, granular powder made from the spray method, or pulverized powder made from crusher machines. Other powders that can be used at those for the solution spray method using aqueous solution containing a mixture of salt in the desired composition ratio, or powder used in the spray pyrolysis method using piezoelectric elements and two-fluid type nozzle. The raw powder for the present invention encompasses various configurations that consist of particles regardless of form such as powder, granular powder and pulverized powder. For example, when Fe powder is to be ultimately obtained, it is cost efficient to use iron oxide powder. The particle size of raw powder may be set in the range of about 0.1–100 μm. However, it is preferred that the powder be formed in the particle size of about 0.5–50 μm, or more preferably between about 1 and 20 μm. If the particles of the powder are too small, they tend to attach themselves on the surface of the larger particles, and they are unsuitable to be mixed with resin. Moreover, if the particle size is too large, the reducing conditions and the conditions for producing single crystal particles become increasingly stringent. Pyrolysis under the present invention means a chemical reaction where two or more compounds change to a simple substance when heat is applied. Needless to say, this pyrolysis concept also includes a reducing reaction implemented by adding heat.

One characteristic that is different from the metal powder manufacturing method under the conventional spray pyrolysis method is the fact that, in the present invention, raw powder in its dry state is used. This is because a large amount of water vapor inevitably generated in the spray pyrolysis method lowers the reducing density, making it impossible to create metal elements with a stronger affinity to the reduced subject. The dry state here does not require any special drying process for the raw powder. It means that powder in a wet state, as in the slurry form or the solution form of the starting raw material like in the case of conventional spray pyrolysis method is not included.

Figure 2:
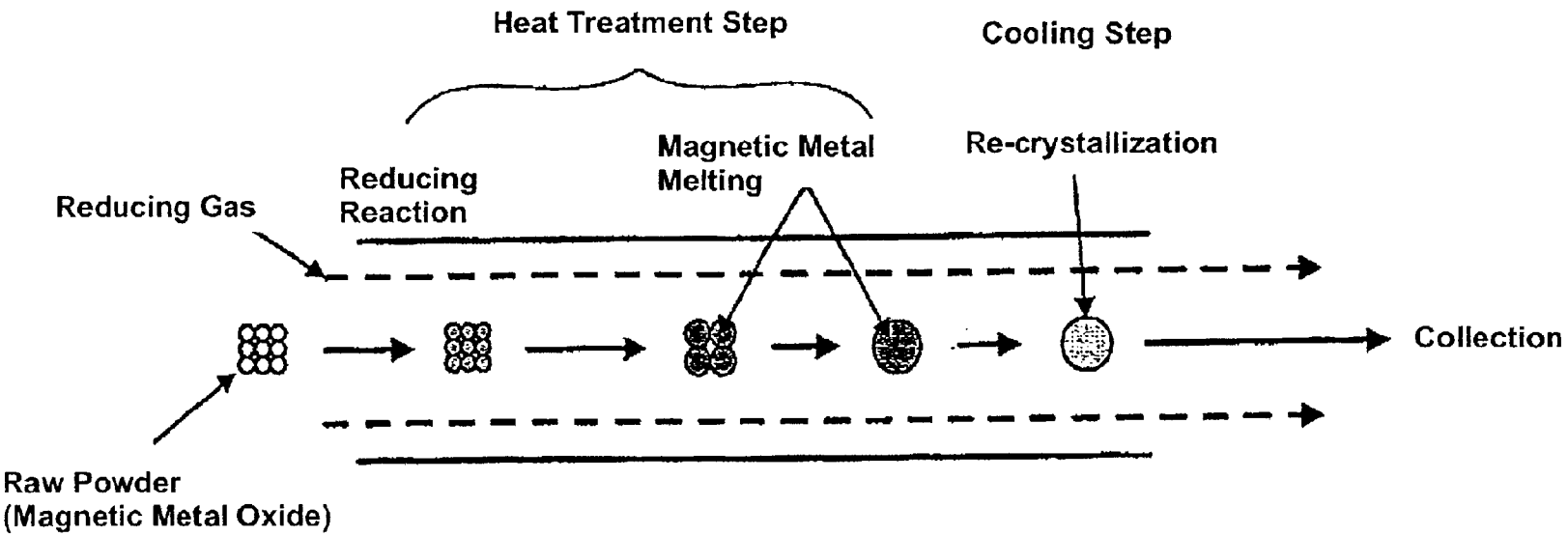
FIG. 2 is an illustration for describing a process of forming magnetic metal powder in accordance with an embodiment of the present invention.
Figure 3:
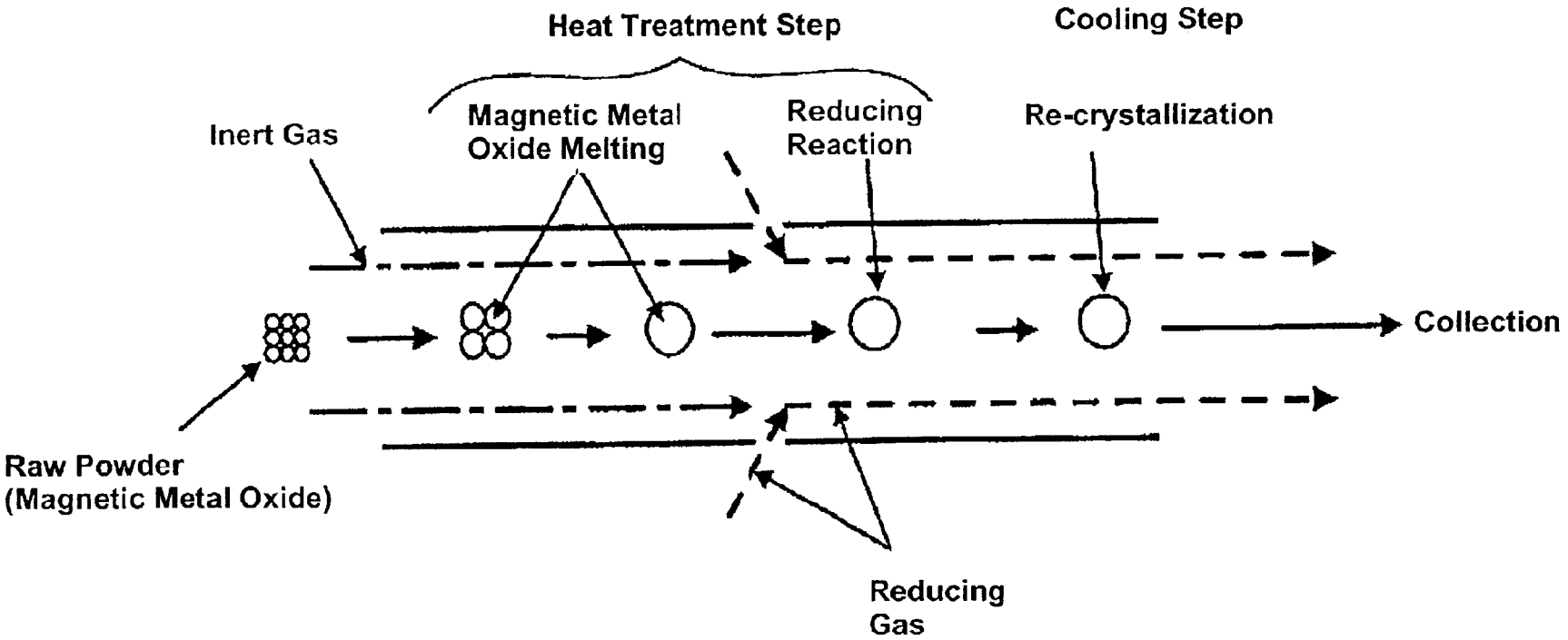
FIG. 3 is an illustration for describing a process of forming magnetic metal powder in accordance with an embodiment of the present invention.

Next, the transition of raw powder in the heat treatment step and cooling step is explained with FIGS. 2 and 3. For the convenience of the explanation, the magnetic metal oxide powder is used as the raw powder. Also, FIG. 2 shows an example where the magnetic metal oxide is melted after being reduced, and solidified through cooling. FIG. 3 shows an example where magnetic metal oxide is reduced after being melted and then cooled to solidify the powder.

In FIG. 2, the magnetic metal oxide powder is sent to the heat treatment step with the carrier gas that consists of reducing gas. At this point, if the heating temperature of the heat treatment step is designated as T, the reducing temperature of the magnetic metal oxide as Tr and the melting point of the magnetic metal as Tm, then the relationship between them is T>Tm>Tr. If the magnetic metal oxide powder is supplied to the heat treatment step whose heating temperature is controlled at T, the magnetic metal oxide powder will complete its reducing process when the temperature reaches Tr, and changes from an oxide with a high melting point to magnetic metal particles with a low melting point. Subsequently, the magnetic metal particles will melt as thermal energy higher than the melting point Tm is supplied. Plural molten particles will combine to form a new molten particle. This new molten particle will re-crystallize at the cooling step to form a single crystal magnetic metal powder.

Next, FIG. 3 shows how the magnetic metal oxide powder is transferred to the heat treatment step with the carrier gas that consists of inert gas. The magnetic metal oxide melts at the heat treatment step. After it melts, a reducing reaction is caused by supplying reducing gas to the heat treatment process. The molten substance obtained at this point is a melt from the said magnetic metal. This melt begins to re-crystallize when it reaches the melting point during the cooling process, and it will be essentially composed of single crystal magnetic metal powder at the stage where it solidifies. In this example in FIG. 3, the magnetic metal oxide powder initially melts when the carrier gas not containing reducing gas is used. Next, the reducing gas is supplied to cause reducing reaction to the molten substance.

As shown in FIGS. 2 and 3, two forms of solidification methods can be used in this invention: on of them is to cool and solidify the substance after it is reduced and melted, and the other is to cool and solidify the substance after it is melted and reduced. However, depending on the heat treatment temperature and other conditions, there are cases when reducing and melting become mixed, making them both difficult to distinguish one from the other. The present invention also encompasses this type of situation.

One of the characteristics of this invention is that the particles, which are a product created by the reducing process, are heated to temperatures higher than the particle's melting point and to destroy the crystal of the raw powder. Even if the raw powder is a mass of irregular shaped crushed powder, or granular powder in a cohered form of fine particles, they become single liquid droplets once they are melted. The melt-turned liquid droplets form spherical shapes through surface tension. Re-crystallized spherical magnetic metal powder is obtained by having the droplets go through the cooling process. This metal powder is single crystal, and its mean particle size can be within a range of about 0.1–20 μm.

The above was an explanation of the desirable mode of obtaining single crystals in accordance with the present invention by melting the raw powder. However, the present invention is not restricted to this mode, and it is possible to obtain magnetic metal powder without melting the raw powder. But in this case, there is the possibility that the magnetic metal powder will maintain its irregular shape if the raw powder is shaped irregularly, and it will not be possible to obtain the powder in single crystal form. Moreover, in the reducing process, the reducing takes place first from the surface of the powder, making it possible for the reducing process to end while leaving the particles hollow, thus resulting in producing many defective particles. The same can be said when the starting raw material is granular powder. Therefore, it is recommended that the raw powder be melted first in order to obtain magnetic metal powder with excellent properties. That is, by melting the raw material first, it is possible to expel the impurities in the raw powder to the surface of the liquid droplets, thus enabling the manufacturing of single crystal metal particles with a degree of purity higher than the raw powder as well as being spherical. Also, by melting the raw material, it makes it possible to produce an alloy if the raw powder contains more than one type of element. But in this case, there is the possibility that the magnetic metal powder will maintain its irregular shape if the raw powder is shaped irregularly, and that there is a possibility that there will be many defective powder particles as well as being unable to obtain the powder in single crystal form. Moreover, in the reducing process, the melting and reducing takes place first from the surface of the powder because the surface has a temperature higher than its interior, making it possible for the reducing process to end while leaving the particles hollow. Also, in the case of granular powder, it will be difficult to obtain particles with a higher percentage of alloy content (i.e., highly alloyed particles) for the magnetic metal powder. With little progression of alloying, the result will be mixed metal particles with a high percentage of respective metal particles. Since this too will see the reducing and melting start from the exterior of the powdered substance rather than the interior during the reducing process the reducing process may end with many hollow or defective particles.

With the present invention, it is possible to effectively utilize the reducing capacity of the reducing gas because the effects from water vapor can be restrained during the reducing process as the raw powder contains little moisture. Therefore, compared to the conventional spray pyrolysis method of thermally decomposing the raw powder as an aqueous solution, the present invention makes it possible to increase the volume of reducing process of the powder in terms of unit volume at a lower temperature.

In accordance with the present invention, it is possible to form a coated layer around the magnetic metal powder in order to strengthen or add various functions to the powder. While this coated layer can be obtained through a special process of forming the layer after obtaining the magnetic metal powder, this invention proposes a method of forming the coating during the manufacturing process of the magnetic metal powder. This coating layer, for example, may be formed from a compound consisting of elements with a strong affinity to oxygen because oxygen will be the target element for reducing in the case of oxides. Therefore, the reducing conditions that form the elements of the respective coating will be determined by the affinity with respect to the element targeted for reducing. And, several methods can be used to form the coating layer from these compounds. The method can be distinguished by the mode in which the compounds forming the coating layer are supplied.

Figure 4:
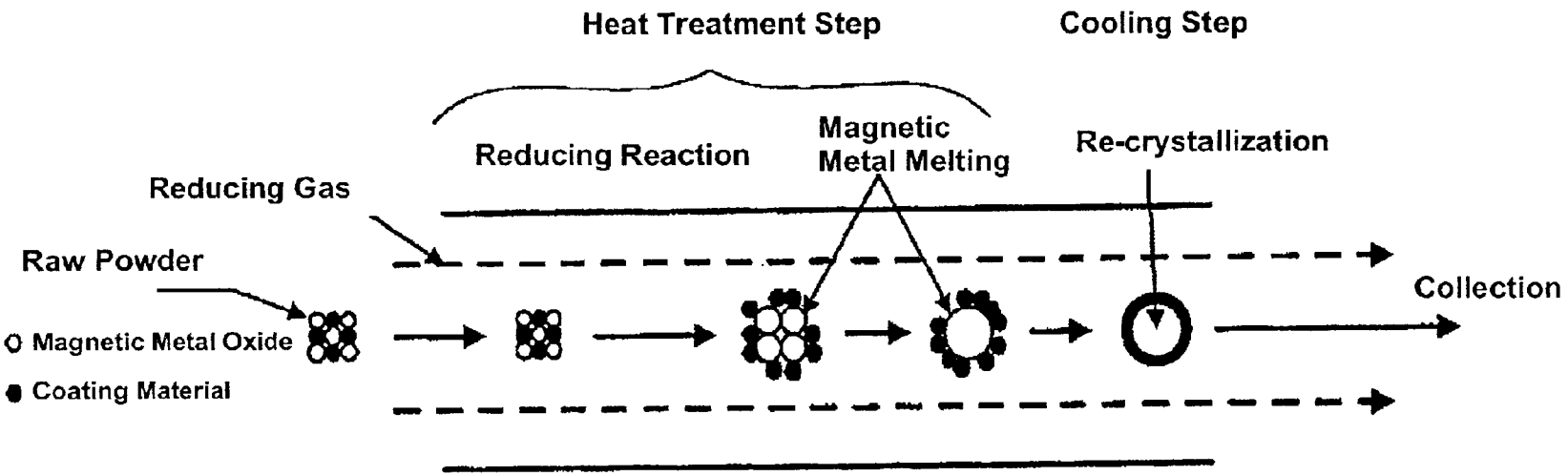
FIG. 4 is an illustration for describing a process of forming magnetic metal powder in accordance with an embodiment of the present invention.
Figure 5:
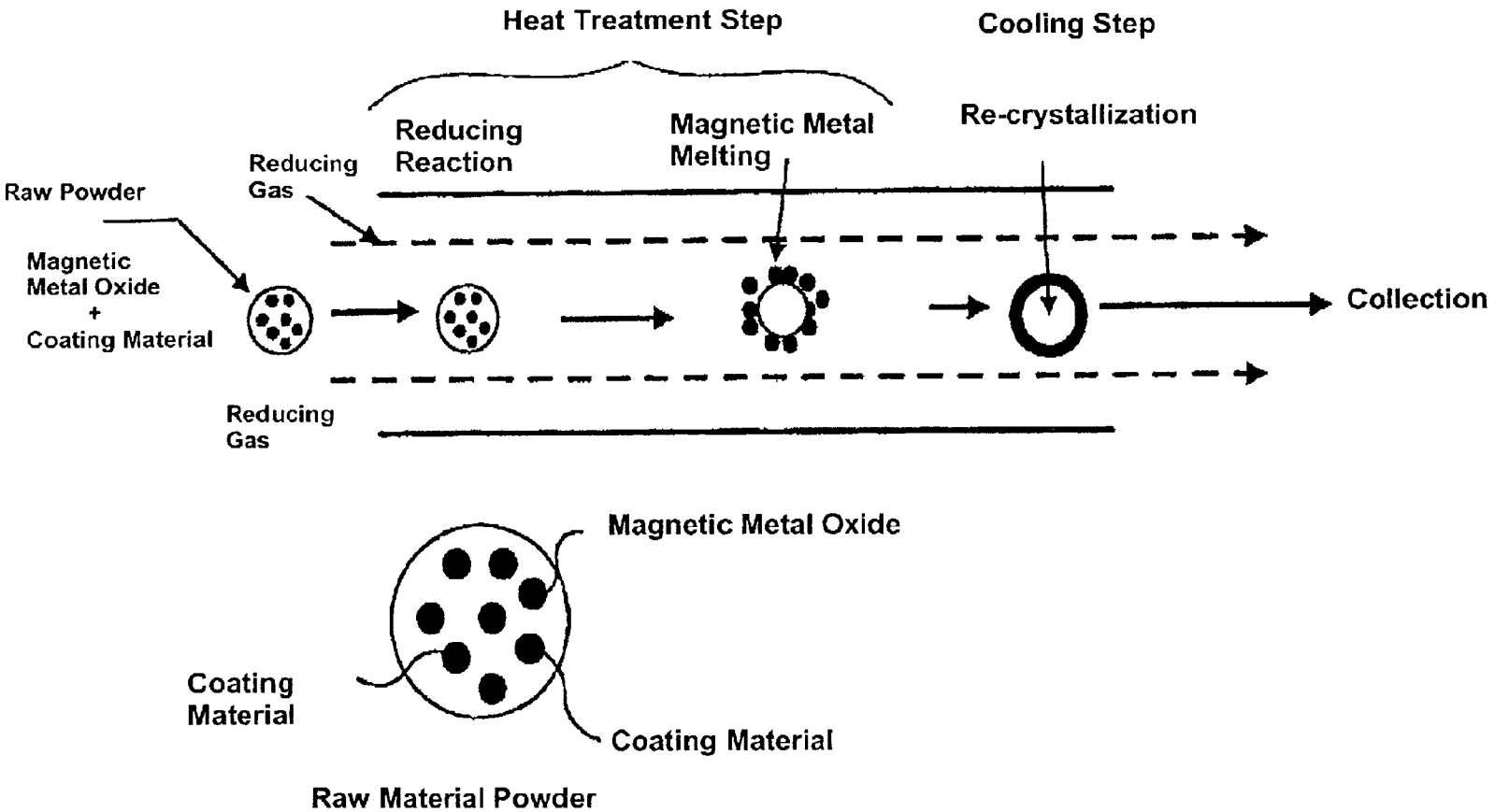
FIG. 5 is an illustration for describing a process of forming magnetic metal powder in accordance with an embodiment of the present invention.
Figure 6:
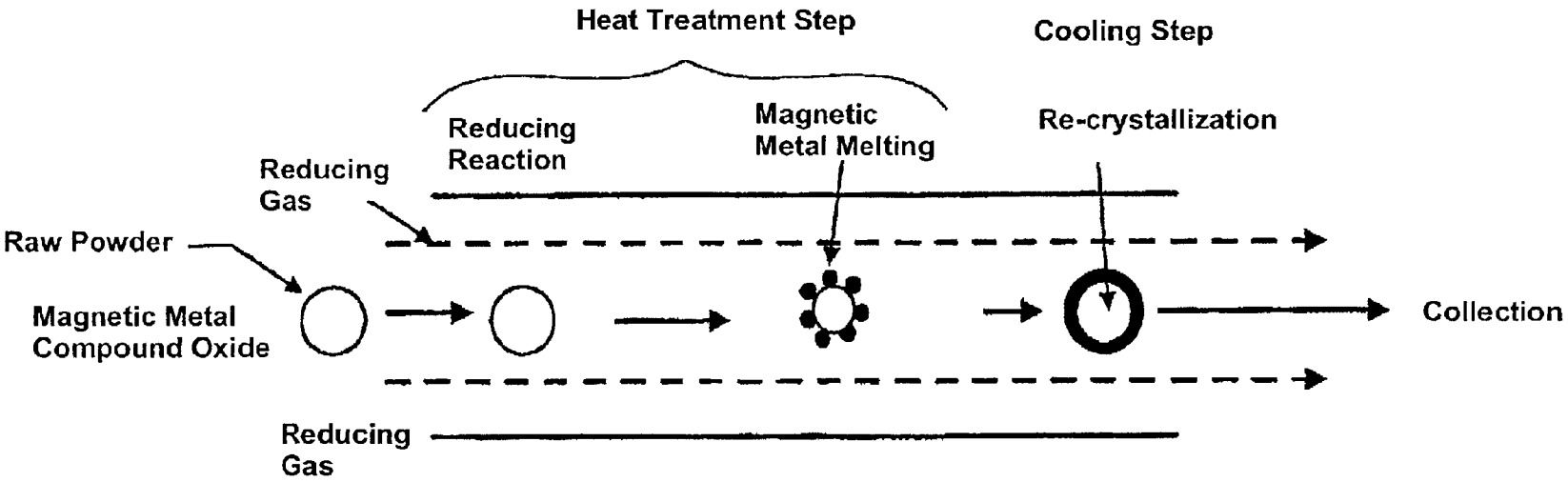
FIG. 6 is an illustration for describing a process of forming magnetic metal powder in accordance with an embodiment of the present invention.

The first method entails supplying a compound that comprises the coating layer as a mixture with the raw powder for the magnetic metal powder. This method can be classified into two modes with the first entailing the supplying of the raw powder as a mixture with the powder of the compound that comprises the coated layer, and the second involving the supplying of raw powder with the compound that comprises the coated layer dispersed within the raw material. The former contains granular powder mode comprising two types of powder. The second method is a method of supplying a composite compound, such as a composite oxide, including magnetic metal and an element that has a reducing power stronger than the said magnetic metal. FIGS. 4 to 6 will be used as reference in explaining the respective methods. Needless to say, while FIGS. 4 to 6 illustrate the mode for melting the raw material after the reduction, there is also a mode to perform the reduction after the material is melted.

First, FIG. 4 will be used to explain the mode in the first method for supplying a mixture of powder comprising the raw material and the compound powder that composes the coated layer. Here too magnetic metal oxide powder will be used as the example for the raw powder.

What is supplied with the magnetic metal oxide is a compound powder (coating material) that consists of at least one element with a stronger affinity to the element traded off in the reducing process from the magnetic metal. This compound is difficult to be reduced even under the temperature range where the magnetic metal oxide is reduced. While there are no particular requirements for the types of compounds, some of those that can be listed, for example, are oxides of Si, Ti, Cr, Mn, Al, Nb, Ta, Ba, Ca, Mg and Sr, which have a strong affinity to oxygen than that of the ultimate magnetic metal to be obtained, such as Fe. At this point, if the heating temperature of the heat treatment process is designated as T, the reducing temperature of the magnetic metal oxide as Tr1, the reducing temperature of the coating material as Tr2, the melting point of the magnetic material as Tm1 and the melting point of the coating material as Tm2, then the condition Tr2>T>Tm2>Tm1>Tr1 is satisfied. However, this relationship is merely one example, and does not mean that the present invention excludes other relationship. For example, in one embodiment, the present invention can be implemented even if the relationship is Tr2>Tm2>T>Tm1>Tr1, or even if the melting temperature and reducing temperature against the compound that becomes the coating material or the metal is reversed. Moreover, if the conditional relation is T>Tr2>Tm2>Tm1>Tr1, and T is close to Tr2, some of the substances will exist as metal or melt in magnetic metal, and the compounds not reduced will become the coating material if the reducing reaction does not completely progress due to the forming condition or the reducing condition.

For example, if two elements exist within one particle, and the melting point and reducing temperature of each of the elements are Tm1, Tr1, Tm2, Tr2, if the conditional relation is given by T>Tr2>Tm2>Tr1, then T will be larger than Tr2. If two elements are reduced, an alloy particle can be formed because the elements mutually melt. When heat energy that completely reduces the two elements is applied, it is possible to form spherical alloy particles. The degree of alloy and crystallization will be dependant on the cooling speed.

Even if the coating material is reduced, unless the elements comprising the coating are reduced to the respective element units, they can become coating material.

If a mixture of oxidized magnetic metal powder and coating material are fed to the heat treatment process at a temperature controlled at T, the magnetic metal oxide will be reduced at Tr1. Since the coating material is not reduced at this temperature, the initial mode of the oxide is maintained. Subsequently, it melts because the magnetic metal resulting from the reduction is heated to temperature T, which is higher than Tm1, the melting point of the magnetic metal. However, the coating material will melt because its melting point Tm2 is lower than the heat treatment temperature T. Also, as heat treatment temperature T is lower than the coating material reducing temperature Tr2, the coating material will not be reduced. A particle of liquid droplet is formed such that magnetic metal with a high specific gravity that occupies a large portion of the volume melts and gathers at the center section, and meanwhile the coating material with a lower specific gravity is expelled to the outer periphery. It is believed that the reason the un-melted coating material is ejected to the surface of the droplet is because the magnetic metal in a state of a liquid droplet is affected by external factors to cause a slow rotation on its axis, and is thus affected by its centrifugal force. Subsequently, re-crystallization takes place as the particles start to cool from within in the cooling step with the coating material expelled to the surface and a nucleus of crystals forming in the magnetic metal with the lowering of the temperature. The unreduced coating material is cooled in a separate state from the magnetic metal. Then, the powder thus obtained takes the form of single crystal and spherical magnetic metal particles each coated around with an oxide. By controlling the size of the coating material added together with the raw powder, the coating layer can be formed in uniform thickness. What is important in obtaining a coating layer is to maintain the supply volume and size of the coating material within the prescribed range. If the volume of coating material increases, there is the possibility that there will be no rotation of the magnetic metal at the melting stage. This is also because the molten magnetic metal will find it difficult to collect in the center.

Next, FIG. 5 will be used to explain a mode in the first method for supplying the raw powder with a compound that composes the coating layer being dispersed within the raw material. In FIG. 5, the raw powder has its matrix as magnetic metal oxide powder, and takes the form in which coating material is dispersed within the powder. A typical example of this mode is iron oxide ($Fe_2O_3$) containing $SiO_2$ as impurities.

The raw powder is supplied to the heat treatment step by using reducing gas as the carrier gas. At the heat treatment step, the magnetic metal oxide that comprises the mother material is the first to be reduced. At this juncture, the coating material dispersed within the magnetic metal oxide is not reduced and maintains its initial mode. Therefore, through the reducing process, magnetic metal particles with coating material dispersed are formed. Next, of the magnetic metal particles with coating materials dispersed within, the magnetic metal portion melts. As the magnetic metal melts, the coating material is expelled to the outer circumference of the molten metal, as in the case of the example explained above. Subsequently, re-crystallization takes place as the particles start to cool from within in the cooling step with the coating material expelled to the surface and the nucleus of crystals forming in the magnetic metal with the lowering of the temperature. The unreduced coating material is cooled in a separate state from the magnetic metal. Then, the powder thus obtained takes the form of single crystal and spherical magnetic metal particles each coated around with an oxide layer.

Next, the second method noted previously will be explained by using FIG. 6. The second method entails supplying a composite compound including magnetic metal and an element with a reducing power stronger than that of the magnetic metal, for example a composite oxide. This oxide is called a magnetic metal composite oxide, and a specific example is $FeAl_2O_4$.

FIG. 6 shows magnetic metal composite oxide, the raw powder, being supplied to the heat treatment step using reducing gas as the carrier gas. At the heat treatment step, the magnetic metal composite oxide is reduced and decomposed into magnetic metal and oxide. In the case of $FeAl_2O_4$ as an example, the composite oxide is decomposed into Fe and $Al_2O_3$. $Al_2O_3$ becomes the coating material.

Subsequently, the temperature of the magnetic material rises above its melting point, causing it to melt. Then, the coating material $Al_2O_3$ is ejected to the outer periphery. Then, at the cooling step, crystal nucleus forms in the magnetic metal as the temperature drops from within the particles to start the re-crystallization process, with the coating layer expelled to the surface. The powder, thus obtained, becomes a spherical and single crystal magnetic metal particle coated with $Al_2O_3$.

Also, if the conditions are set to weaken the reducing power, part of the Fe, the magnetic metal, will form a compound ($FeAl_2O_4$) with Al, and the compound may become the coating material.

Figure 7:
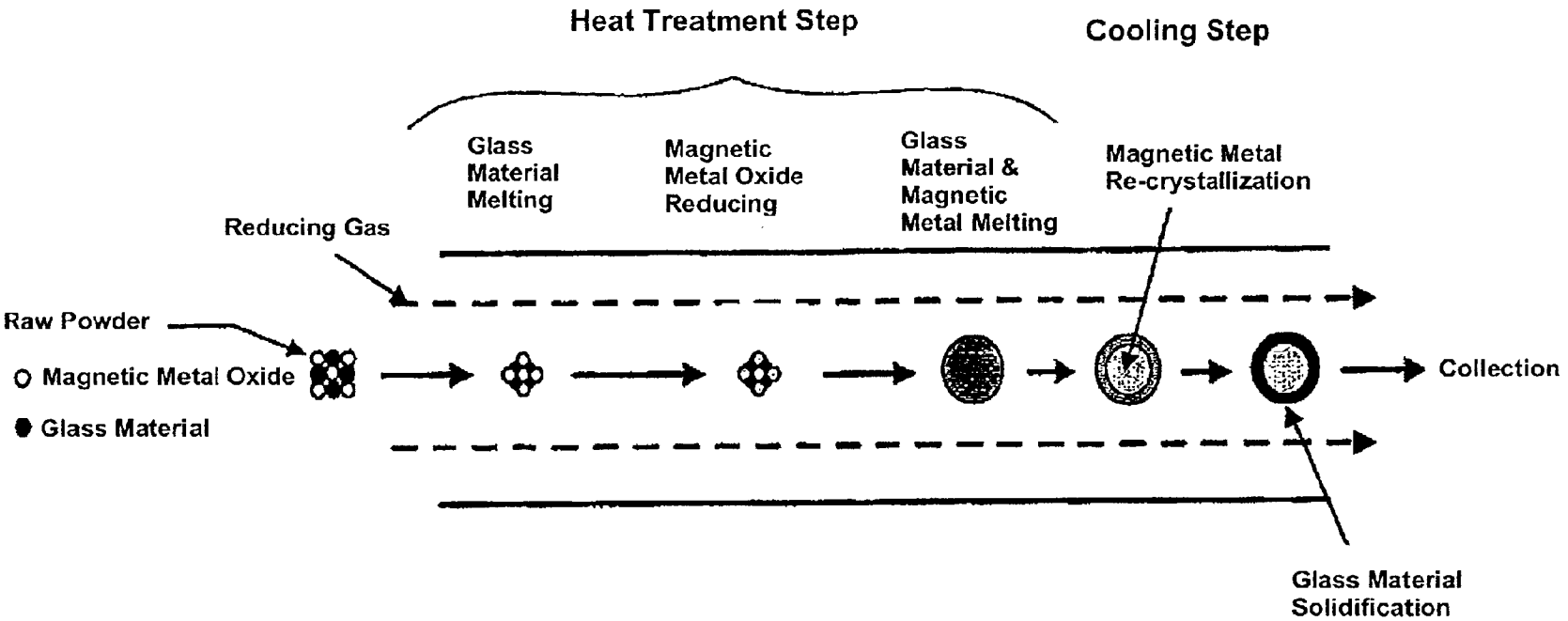
FIG. 7 is an illustration for describing a process of forming magnetic metal powder in accordance with an embodiment of the present invention.

The mode explained above shows an example where the coating material maintains its solid state. But in the process of forming the coating layer, it is possible to melt the coating material and use ceramics and glass materials with a lower melting point than that of the magnetic metal as the coating material. The ceramics can be either barium titanate, strontium titanate or ferrite magnetic material. An example of glass material will be explained, using FIG. 7. Moreover, as described above, the glass material consists of a compound that contains an element with stronger reducing power than that of the magnetic metal.

The coating material consisting of magnetic metal oxide and glass material is supplied by using reducing gas as the carrier gas. At this point, if the heating temperature of the heat treatment process is designated as T, the reducing temperature of the magnetic metal oxide as Tr, the melting point of the magnetic material as Tm1 and the melting point of the coating material as Tm3, then the condition T>Tm1>Tr1>Tm3 is satisfied. However, this is just one example of the relationship, and does not mean that the present invention is exclusive of other relationship.

In the heat treatment step, the glass material with the low melting point is to first to melt at Tm3. Next, the magnetic metal oxide is reduced at Tr1. Next, the magnetic metal obtained from the reducing process is melted when the temperature reaches Tm1. At this stage, the magnetic metal and glass material are both melted. At this time the glass material, i.e., the coating material, maintains its molten state, but is spontaneously ejected to the periphery because its specific gravity is lower than that of the magnetic metal. It is at the subsequent cooling step that the re-crystallization process of the magnetic metal begins, starting with the drop in temperature from within the molten particles, and the magnetic metal with a higher melting point forms the crystal nucleus first. As the molten glass material is in a state of rotation because of the particles being influenced by external factors, it coats uniformly on the surface through centrifugal force. Also, even if the coating material completely melts, it is believed that, because of the physical characteristics of the metal and coating compound, they do not become a solid solution, but maintain their mutual states separately. It is believed that some type of chemical bonding takes place at the interface of the magnetic metal and glass material. Subsequently, as the temperature declines the glass material coheres on the surface of the single crystal magnetic metal, giving a uniform coating layer on the magnetic metal powder.

In the above method to form a coating layer with glass material, thermal energy higher than the melting point is applied on the magnetic metal. However, it is possible to manufacture magnetic metal powder with glass coating layer without applying this type of heat energy. However, such magnetic metal powder is polycrystalline powder, and in some case non-spherical.

In this method, if the heating temperature of the heat treatment process is designated as T, the reducing temperature of the magnetic metal oxide as Tr, the melting point of the magnetic material as Tm1 and the melting point of the coating material (glass material) as Tm3, then the method can be performed when the condition Tm1>T>Tr1>Tm3 is satisfied. In this case, the glass material with a low melting point melts at Tm3 during the heat treatment process. At this point, the magnetic metal oxide powder occupies a large portion of the total volume, and thus a reaction takes place on the surface of the respective particles. Because of this, the powder comes together and becomes concentrated in the center of the powder. On the other hand, the molten glass material does not come together within the interior, but gathers at the surface of the cohesive powder. Subsequently, the magnetic metal oxide ends its reducing reaction at Tr1 to form a cohesive unit of polycrystalline metal. In the cooling process, this cohesive unit forms a polycrystalline magnetic metal powder with coating layer as the glass material congeals on the surface. In this manner, if glass material that melts at a lower temperature than the magnetic metal oxide is selected as the coating element, it is possible to obtain polycrystalline magnetic metal with a coating layer formed around the powder.

By forming a coating layer, the insulation property, resistance to acid and non-cohesiveness can be enhanced for the magnetic metal powder. The coating layer also gives the powder the effect of preventing oxidation from heat.

Moreover, by adding alkaline-earth metal, it is possible to further enhance the effect of preventing oxidation by heat. Moreover, as explained previously, the coating layer may be formed after the magnetic metal powder is obtained.

EMBODIMENT EXAMPLES

The present invention is explained with specific embodiment examples below.

Embodiment Example 1

Raw powder, an iron oxide ($Fe_2O_3$) powder with a mean particle size of 3 μm, was fed to the heating furnace using as carrier gas a mixture of 68% hydrogen+nitrogen which acts as the reducing gas. The degree of purity of the iron oxide ($Fe_2O_3$) powder is 99.9%. The flow volume of carrier gas was 3 liters/minute. The temperature inside the furnace (heat treatment temperature) was 1,650° C. Moreover, the melting point of the iron oxide ($Fe_2O_3$) is 1,550° C. and the melting point of Fe is 1,536° C.

Figure 8:
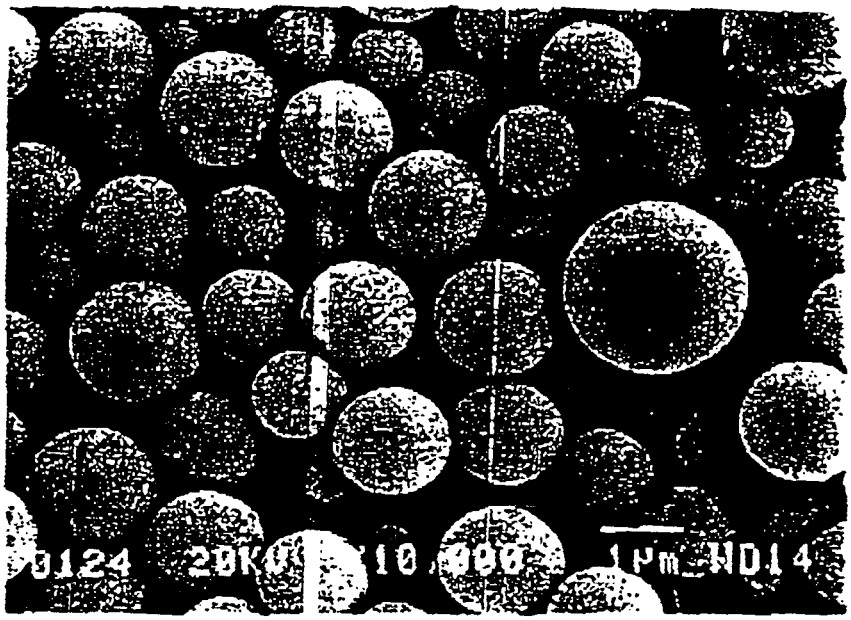
FIG. 8 is a photograph of an SEM image of magnetic metal powder obtained in accordance with a first embodiment example of the present invention.
Figure 8:
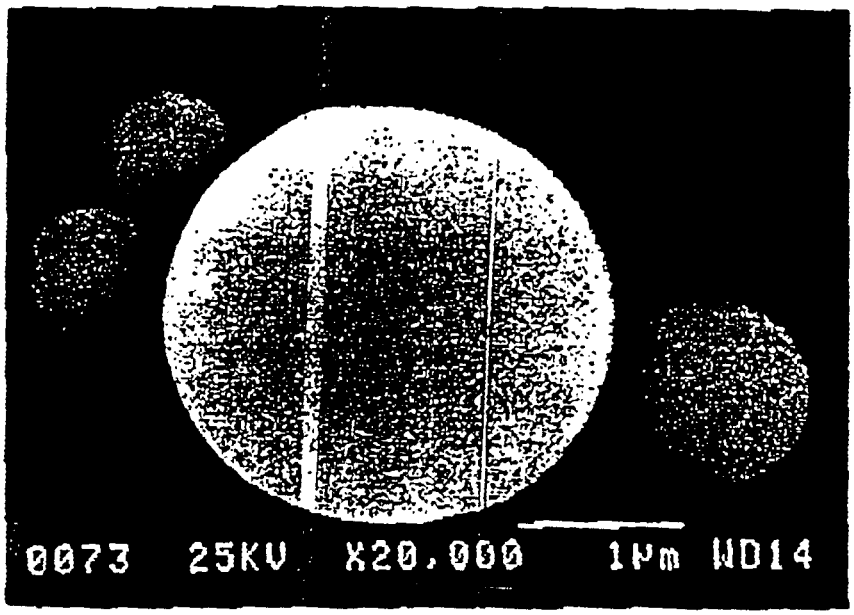

The powder thus obtained was observed with a scanning electron microscope (SEM). The results are shown in FIG. 8, and it was verified that the powder was in spherical form. Also, when the particle size of the powder was measured by a particle size distribution measurement instrument (LA-920 manufactured by Horiba Seisakusho), it was verified that the particle size distribution was from 0.5 μm to 6 μm, and the mean particle size was 2.2 μm.

Figure 9:
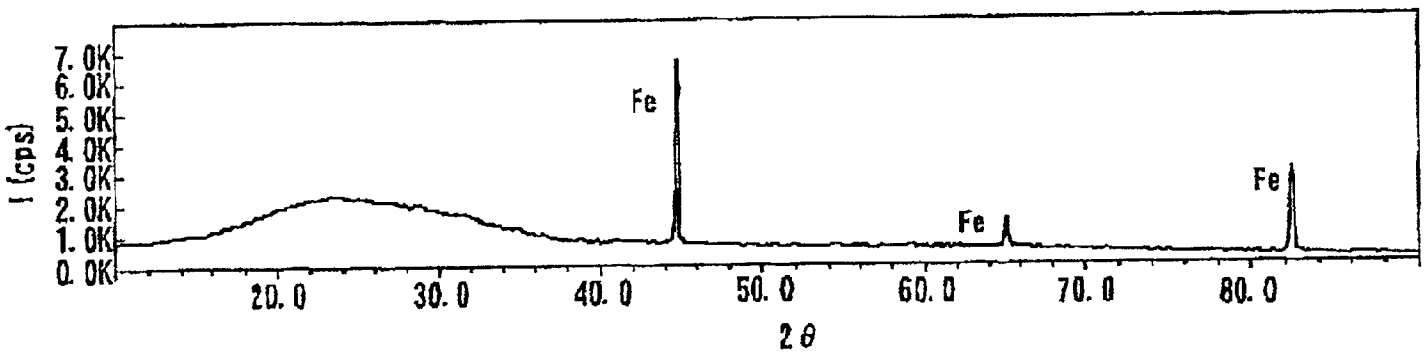
FIG. 9 shows a chart of results of X-ray diffraction analysis conducted on magnetic metal powder obtained in accordance with a third embodiment example of the present invention.

The powder was subjected to X-ray diffraction. The results shown in FIG. 9 verified only the peak indicating Fe. Also, when electron diffraction was conducted, it was verified that the powder obtained consisted of single crystal Fe.

The magnetic characteristics of several types of powder obtained through similar process were measured. The results are shown in Table 1. It was verified that saturated magnetic flux density (Bs) of more than 2.0T could be obtained.

TABLE 1

| No. | Saturated Magnetic Flux Density (Bs) (T) |
|---|---|
| 1 | 2.07 |
| 2 | 2.07 |
| 3 | 2.07 |
| 4 | 2.08 |
| 5 | 2.07 |
| 6 | 2.08 |
| 7 | 2.08 |
| 8 | 2.08 |
| 9 | 2.08 |

Embodiment Example 2

Raw powder, an iron oxide ($Fe_2O_3$, purity 99.7%) powder with a mean particle size of 0.2 μm, was fed to the heating furnace using as carrier gas a mixture of 4% hydrogen+Ar which acts as the reducing gas. The flow volume of carrier gas was 2 liters/minute. The temperature inside the furnace (heat treatment temperature) was 1,600° C. The powder thus obtained was observed with a scanning electron microscope (SEM), and it was verified that the powder particles were in a spherical shape. Also, when the particle size of the powder was measured by a particle size distribution measurement instrument, it was verified that the particle size distribution was from about 0.1 μm to 1 μm. It is believed that the reason particles having a particle size as large as 1 μm were obtained from raw powder of 0.2 μm was because part of the raw powder was melted with the powder being cohered, and the melt solidifying during the cooling process.

The powder was subjected to X-ray diffraction, and only the peak indicating Fe was verified. Also, when electron diffraction was conducted, it was verified that the powder obtained consisted of single crystal Fe.

Embodiment Example 3

A slurry was made with 90 weight portion of iron oxide ($Fe_2O_3$, purity 99.9%) with a mean particle size of 0.1 μm as raw powder and 10 weight portion of $SiO_2$ with mean particle size of 0.3 μm with 6% diluted binder (PVA). Then, a spray drier was used to create granular powder with particle distribution ranging from 0.5 to 20 μm. The powder was produced by feeding the granular powder to the heating furnace with a carrier gas containing 52% hydrogen+Ar. The flow volume of the carrier gas was 2 liter/minute, and the furnace temperature (heat treatment temperature) was 1,650° C. The melting point of $SiO_2$ is 1,713° C.

Figure 10:
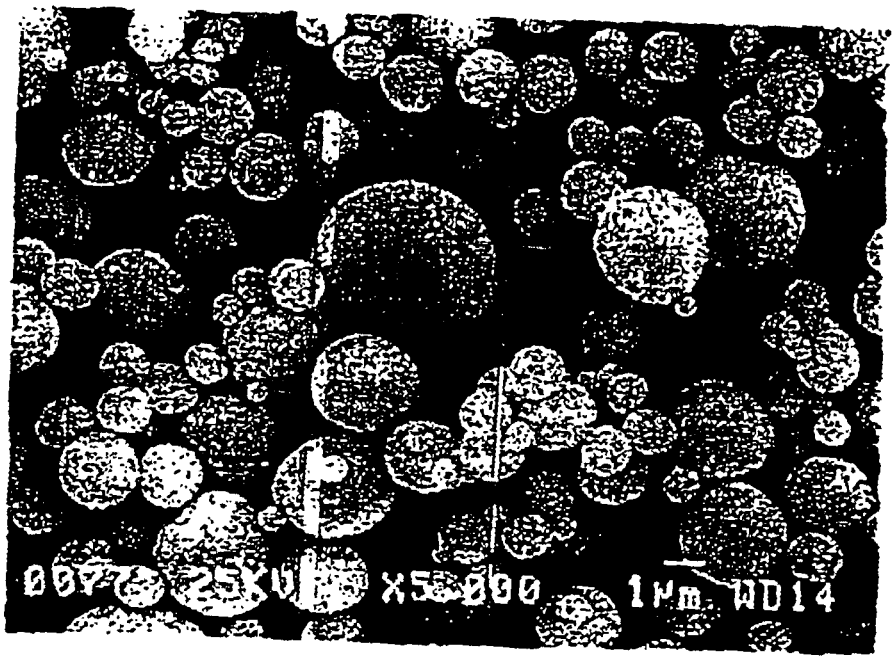
FIG. 10 is a photograph of an SEM image of magnetic metal powder obtained in accordance with a third embodiment example of the present invention.
Figure 10:
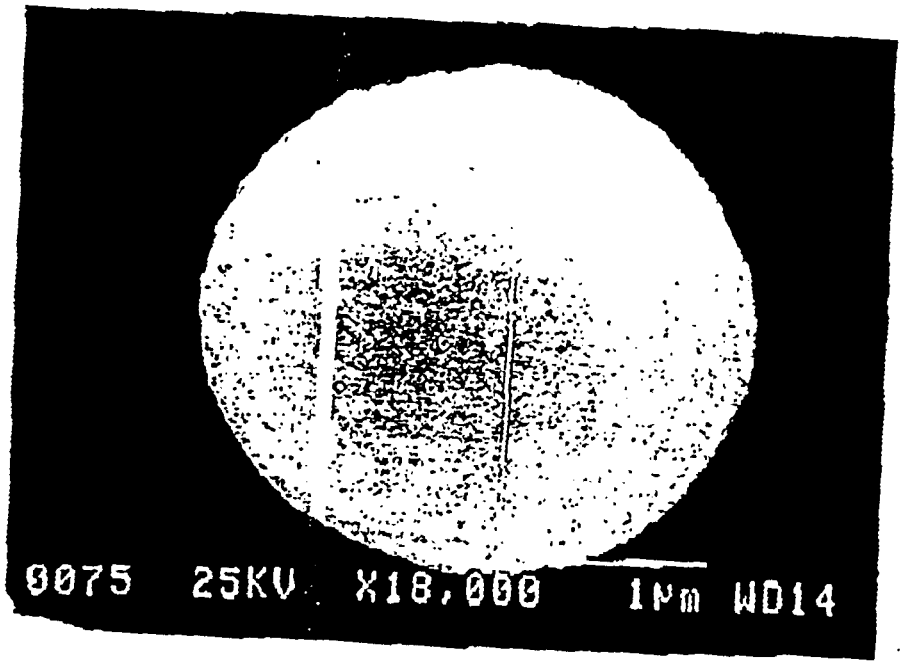

The powder, thus obtained, was observed with a scanning electron microscope (SEM). The results, shown in FIG. 10, verify that the powder was in a spherical shape. Also, when the particle size of the powder was measured with a particle size distribution measuring instrument, it was verified that the particle size distribution ranged between about 1 and 8 μm and the mean particle size was 2.57 μm.

Figure 11:
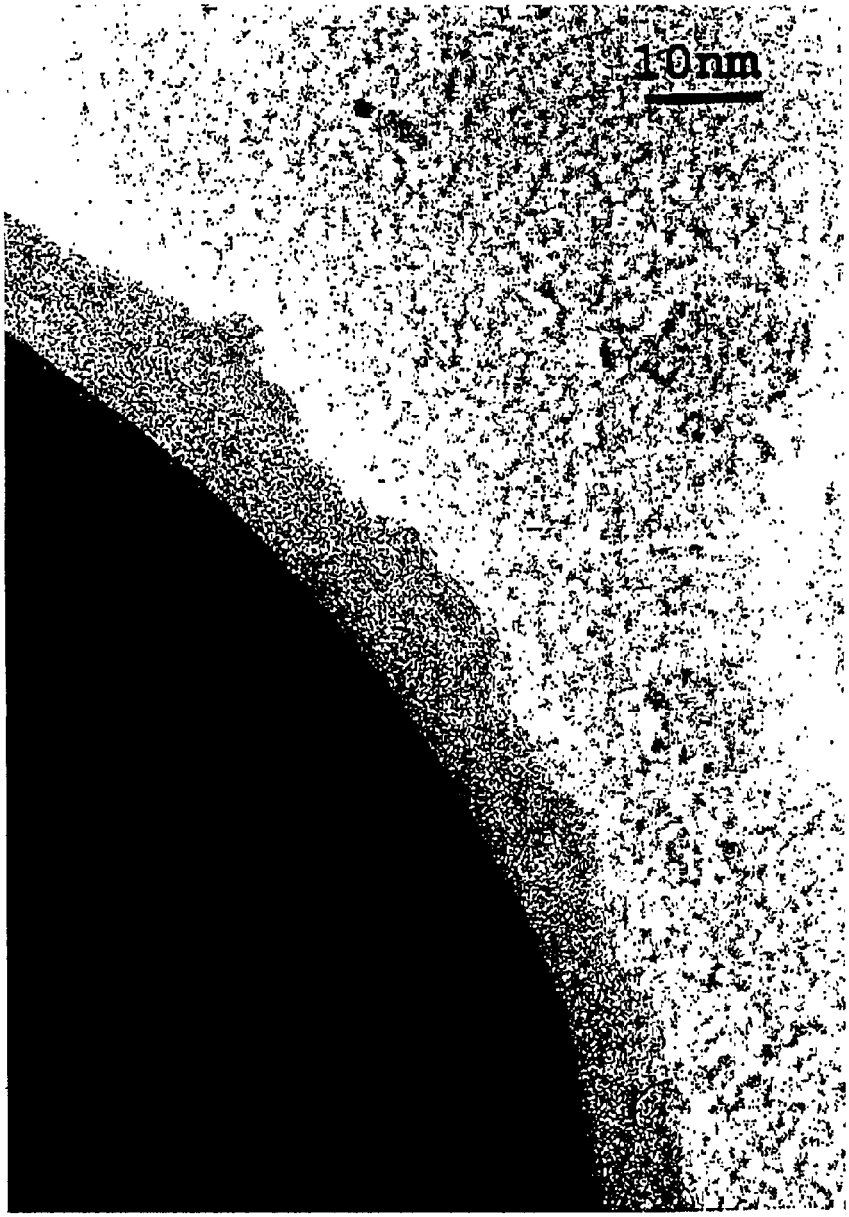
FIG. 11 is a photograph of a TEM image of magnetic metal powder obtained in accordance with the third embodiment example of the present invention.

The powder was also observed with a transmission electron microscope (TEM). The TEM image shown in FIG. 11 verifies that a coating layer is formed on the surface. Moreover, the results from electron diffraction verified that the center part of the powder particle consisted of a single crystal Fe particle and a coating layer composed of amorphous substance. As considerable amount of Si elements were detected in the coating layer, it was judged that the coating layer comprised of amorphous $SiO_2$.

When the powder's magnetic characteristics of the powder thus obtained were measured, it was verified that the saturation magnetic flux density (Bs) was 1.85T. In this manner, the powder in this embodiment example exhibited excellent characteristics of more than 1.8T even with a coating layer.

Embodiment Example 4

A raw powder slurry was prepared with 80 mol % of Fe in iron oxide (Fe2O3, purity 99.9%) with a mean particle size of 0.1 μm and 20 mol % of Si in an aerosol of silica with binder (PVA) diluted at 5%. Then, a spray drier was used to create granular powder with particle distribution of from about 0.5 to 20 μm. The powder was produced by feeding the granular powder to the heating furnace with a carrier gas containing a mixture of 50% hydrogen+50% nitrogen. The flow volume of the carrier gas was 2 liter/minute, and the furnace temperature (heat treatment temperature) was 1,650° C. It was verified from the results of SEM observation that the powder thus obtained was in a spherical shape. The particle size distribution measuring instrument verified that the particle size distribution was about 0.9–8 μm. Also, TEM observation showed that a coating layer was formed on the surface of spherical shaped particles, and the electron diffraction results showed that the center portion of the powder particle was a single crystal Fe particle and that the coating layer consisted of amorphous substance. As considerable amount of Si elements were detected in the coating layer, it was judged that the coating layer comprised of amorphous $SiO_2$.

The volume ratio of the single crystal Fe, the metal magnetic material, and $SiO_2$, the coating material, is approximately 1:1 if it is assumed that the coating material consists entirely of $SiO_2$ with none of the Si elements being reduced.

The magnetic characteristics of the powder thus obtained were measured. As a result, it was verified that the saturated magnetic flux density (Bs) was 1.77T. In this manner, the powder in this embodiment example exhibited excellent characteristics of more than 1.7T even if a coating layer is formed.

Embodiment Example 5

A raw powder slurry was prepared with 90 mol % of Fe in iron oxide ($Fe_2O_3$, purity 99.9%) with a mean particle size of 0.1 μm and 10 mol % of Al in alumina ($Al_2O_3$) aerosol with binder (PVA) diluted at 5%. Then, a spray drier was used to create granular powder with particle distribution of about 0.5–20 μm. The powder was produced by feeding the granular powder to the heating furnace with a carrier gas containing a mixture of 50% hydrogen+50% nitrogen. The flow volume of the carrier gas was 2 liter/minute, and the furnace temperature (heat treatment temperature) was 1,650° C. Also, the melting point of $Al_2O_3$ is 2,050° C.

It was verified that the powder thus obtained was spherical in shape from the results of SEM observation. The particle size distribution measuring instrument verified that the particle size distribution was from about 0.8 to 8 μm, and that the mean particle size was about 2.6 μm. Also, the electron diffraction results showed that the center portion of the powder particle was a single crystal Fe particle and that the coating layer consisted of amorphous substance. As considerable amount of Al elements were detected in the coating layer, it was judged that the coating layer comprised of amorphous $Al_2O_3$.

Embodiment Example 6

A slurry was prepared after weighing iron oxide ($Fe_2O_3$, purity 99.7%) with a mean particle size of about 0.6 μm and nickel oxide (NiO) with a mean particle size of 0.7 μm so that the mole ratio will be 1:1 and mixing them with pure water and a small amount of dispersant. This slurry was mixed for 12 hours in a ball mill. The mixture was dried and calcinated for two hours at 1,000° C. to create a mixed bulk of nickel iron oxide ($NiFe_2O_4$) and nickel oxide (NiO). Raw powder was made from this mixed bulk by pulverizing it to particles with a mean diameter of about 2 μm (the particle size distribution of about 0.2–5 μm). The raw powder was fed to the heating furnace using a carrier gas consisting of a mixture of 50% hydrogen and 50% argon. The flow volume of the carrier gas was 2 liter/minute and the furnace temperature (heating temperature) was 1,650° C. The melting point of an alloy of Ni and Fe formed at a mole ratio of 1:1 was 1,450° C.

It was verified through SEM observation that the powder, thus obtained, was in a spherical shape. This powder takes the form of a mixture of an aggregate of fine particles with a particle size of about 0.1 μm and relatively large particles of about 5 μm. Also, it was observed that some of the fine particles attached themselves to the surface of the larger particles. It was verified that the particle size was between about 0.2 and 5 μm, as measured by using a particle size distribution measurement instrument. Also, it was verified through X-ray diffraction that there was a peak of Ni and Fe alloy at a mole ratio of 1:1.

Embodiment Example 7

A raw powder slurry was prepared with 90 wt % of iron oxide ($Fe_2O_3$, purity 99.9%) with a mean particle size of about 0.1 μm and 10 wt % of glass material (GA-47 manufactured by Nippon Denshi Glass K.K.) consisting of $SiO_2$, $B_2O_3$ and $Al_2O_3$ with binder (PVA) diluted at 5%. Then, a spray drier was used to create raw powder consisting of granular powder with a particle size of about 1–10 μm. The granular powder was fed to the heating furnace with a carrier gas containing a mixture of 50% hydrogen+50% argon. The flow volume of the carrier gas was 2 liter/minute, and the furnace temperature (heat treatment temperature) was 1,600° C. Also, the melting point of the glass material was less than 1,500° C. It was verified from the results of SEM observation that the powder thus obtained was spherical in shape. The particle size distribution measurement instrument verified that the particle size distribution was about 0.8–10 μm. Also, it was verified through TEM observation that a coating layer formed on the surface of the spherical particles. The electron diffraction results showed that the center portion of the powder particle was a single crystal Fe particle and that the coating layer consisted of amorphous substance. As amounts of Al, Si and B elements were detected in the coating layer, it was judged that the coating layer comprised of glass material.

Embodiment Example 8

Iron oxide ($Fe_2O_3$) powder with a mean particle size of about 3 μm and containing 3.7 wt % of silica ($SiO_3$) was fed to the heating furnace with a carrier gas made of a mixture of 50% hydrogen+50% nitrogen which compose the reducing gas. The flow volume of carrier gas was 3 liters/minute and the furnace temperature (heat treatment temperature) was 1,650° C.

Upon observing the powder thus obtained with a scanning electron microscope (SEM), it was verified that the powder was of spherical shape.

Also, when the powder's particle size was measured with a particle size distribution measuring instrument, it was verified that the mean particle size was about 1.7 μm.

An X-ray diffraction and electron diffraction on the powder thus obtained verified that the powder particle was a single crystal Fe particle with $SiO_2$ formed on the surface.

In the Embodiment Example 8, $SiO_2$ was included in the $Fe_2O_3$ as impurities. But in this manner, it is possible to manufacture single crystal Fe powder even if low purity raw material is used. Moreover, the fact that a coating layer can be formed at the manufacturing stage suggests the conspicuous effects of this invention.

Embodiment Example 9

Iron oxide ($Fe_2O_3$) powder with a mean particle size of about 0.1 μm was fed to the heating furnace with a carrier gas made of a mixture 68% hydrogen+Ar which becomes the reducing gas. The flow volume of carrier gas was 3 liters/minute and the furnace temperature (heat treatment temperature) was 1,500° C.

When the particle size of the powder thus obtained was measured with a particle size distribution measuring instrument (LA-920 manufactured by Horiba Seisakusho Co.), it was verified that the particle size distribution was about 0.2–5 μm. Also, upon conducting X-ray diffraction on the powder, only the peak of Fe was verified. Therefore, it could be judged that the iron oxide ($Fe_2O_3$) powder was reduced within the heating furnace.

As the furnace temperature in Embodiment Example 9 was 1,500° C., which was lower than the melting point (1,536° C.) of Fe, the product (Fe) obtained from the reduction does not melt. Therefore, while single crystal and spherical powder could not be obtained, it suggests the effect of this invention that large quantities of Fe powder, magnetic metal, can be manufactured by using the simple method of feeding iron oxide ($Fe_2O_3$) to the heating furnace.

As explained above, the invention makes it possible to obtain spherical and single crystal magnetic metal powder with a particle size of about 0.1–20 μm. Moreover, the present invention makes its possible to manufacture large quantities of magnetic metal powder using a simple method of feeding raw powder with a carrier gas to the prescribed heat treatment stage. Also, it is possible to provide various types of functions on the magnetic metal powder by forming a coating layer on the surface of the magnetic metal powder. Moreover, in accordance with the present invention, coating layers can be formed without adding any special process.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A method for manufacturing magnetic metal powder comprising:

supplying raw powder for forming magnetic metal powder through pyrolysis using a carrier gas to a predetermined heat treatment region;

heating the raw powder at a temperature higher than a thermal decomposition temperature of the raw powder; and cooling a product of the raw powder obtained from pyrolysis to provide the magnetic metal powder, wherein the carrier gas includes a reducing gas, a reduced product is formed by reducing the raw powder in the heating step with the reducing gas, thereafter the reduced product is cooled in the cooling step, a melt of the reduced product is formed in the heating step and the melt is re-crystallized in the cooling step to obtain magnetic metal powder.

2. A method for manufacturing magnetic metal powder according to claim 1, wherein the magnetic metal powder consists essentially of single crystal.

3. A method for manufacturing magnetic metal powder according to claim 2, wherein the magnetic metal powder contains substantially spherical particles.

4. A method for manufacturing magnetic metal powder according to claim 1, wherein the raw powder is an iron oxide powder.

5. A method for manufacturing magnetic metal powder according to claim 1, wherein the raw powder and a powder composed of a compound consisting of at least one element with a reducing power stronger than a reducing power of the magnetic metal included in the raw powder are supplied to the heat treatment region.

6. A method for manufacturing magnetic metal powder according to claim 1, wherein the raw powder contains a compound consisting of at least one element with a reducing power stronger than a reducing power of the magnetic metal.

7. A method for manufacturing magnetic metal powder according to claim 6, wherein the compound contains particles with particle sizes smaller than particles sizes of particles of the raw powder.

8. A method for manufacturing magnetic metal powder according to claim 1, wherein a coating layer is formed on the surface of the magnetic metal powder in the heating step and the cooling step.

9. A method for manufacturing magnetic metal powder according to claim 8, wherein the magnetic metal powder consists of Fe as a main ingredient, and the coating layer is formed by a compound consisting of at least one element with a greater affinity to oxygen than an affinity of Fe.

10. A method for manufacturing magnetic metal powder according to claim 9, wherein the magnetic metal powder consists of particles, each being coated with a coating layer of the compound, and the coating layer is formed by a centrifugal force caused by rotation of each of the particles in the heating step.

11. A method for manufacturing magnetic metal powder according to claim 1, wherein the magnetic metal powder consists essentially of particles with a mean particle size in the range of about 0.1–20 μm.

12. A method for manufacturing magnetic metal powder according to claim 1, wherein the magnetic metal powder contains substantially spherical particles.

13. A method for manufacturing magnetic metal powder according to claim 1, wherein the raw powder is a powdered oxide containing at least one type selected from Fe group elements with a mean particle size of about 0.1–100 μm, and wherein the melt forms magnetic metal powder consisting essentially of at least one type of Fe group elements.

14. A method for manufacturing magnetic metal powder according to claim 13, wherein the magnetic metal powder consists essentially of single crystal.

15. A method for manufacturing magnetic metal powder comprising:

supplying raw powder for forming magnetic metal powder through pyrolysis using a carrier gas to a predetermined heat treatment region;

heating the raw powder at a temperature higher than a thermal decomposition temperature of the raw powder; and cooling a product of the raw powder obtained from pyrolysis to provide the magnetic metal powder.

wherein a melt of the raw powder is formed in the heating step, the melt is reduced, and the reduced melt is re-crystallized in the cooling process step to obtain magnetic metal powder.

16. A method for manufacturing magnetic metal powder according to claim 15, wherein the magnetic metal powder consists essentially of single crystal.

17. A method for manufacturing magnetic metal powder according to claim 16, wherein the magnetic metal powder contains substantially spherical particles.

18. A method for manufacturing magnetic metal powder according to claim 15, wherein the magnetic metal powder contains substantially spherical particles.

19. A method for manufacturing magnetic metal powder according to claim 15, wherein the raw powder is an iron oxide powder.

20. A method for manufacturing magnetic metal powder according to claim 15, wherein the raw powder and a powder composed of a compound consisting of at least one element with a reducing power stronger than a reducing power of the magnetic metal included in the raw powder are supplied to the heat treatment region.

21. A method for manufacturing magnetic metal powder according to claim 15, wherein the raw powder contains a compound consisting of at least one element with a reducing power stronger than a reducing power of the magnetic metal.

22. A method for manufacturing magnetic metal powder according to claim 21, wherein the compound contains particles with particle sizes smaller than particles sizes of particles of the raw powder.

23. A method for manufacturing magnetic metal powder according to claim 15, wherein a coating layer is formed on the surface of the magnetic metal powder in the heating step and the cooling step.

24. A method for manufacturing magnetic metal powder according to claim 23, wherein the magnetic metal powder consists of Fe as a main ingredient, and the coating layer is formed by a compound consisting of at least one element with a greater affinity to oxygen than an affinity of Fe.

25. A method for manufacturing magnetic metal powder according to claim 24, wherein the magnetic metal powder consists of particles, each being coated with a coating layer of the compound, and the coating layer is formed by a centrifugal force caused by rotation of each of the particles in the heating step.

26. A method for manufacturing magnetic metal powder according to claim 15, wherein the magnetic metal powder consists essentially of particles with a mean particle size in the range of about 0.1–20 $\mu$m.

27. A method for manufacturing magnetic metal powder comprising the steps of:

supplying a powdered oxide containing at least one type selected from Fe group elements with a mean particle size of about 0.1–100 $\mu$m in a heat treatment atmosphere;

forming a melt of the powdered oxide in the heat treatment atmosphere; and cooling and solidifying the melt to form magnetic metal powder consisting essentially of at least one type of Fe group elements, wherein a reducing step is conducted in the heat treatment atmosphere after the melt is formed but before the melt is cooled and solidified.

28. A method for manufacturing magnetic metal powder according to claim 27, wherein the magnetic metal powder consists essentially of particles with a mean particle size in the range of about 0.1–20 $\mu$m.

29. A method for manufacturing magnetic metal powder according to claim 27, wherein the magnetic metal powder consists essentially of single crystal.

* * * * *

UNITED STATES PATENT AND TRADEMARK OFFICE

CERTIFICATE OF CORRECTION

PATENT NO. : 6,827,758 B2
DATED : December 7, 2004
INVENTOR(S) : Minoru Takaya et al.

It is certified that error appears in the above-identified patent and that said Letters Patent is hereby corrected as shown below:

Column 1,
Line 53, after “at” and before “temperature” insert -- a --.

Column 2,
Line 21, after “from” and before “gaseous” insert -- the --.
Line 21, after “and” and before “solid” insert -- the --.

Column 3,
Line 40, after “In” and before “present” insert -- the --.

Column 6,
Line 52, change “comprising” to -- comprised --.
Line 54, after “etc.)” insert -- . --.

Column 7,
Line 28, after “method” insert -- , --.

Column 8,
Line 4, change “on” to -- one --.
Line 63, after “process” insert -- , --.

Column 12,
Line 8, after “to” and before “first” insert -- the --.
Line 28, after “declines” insert -- , --.
Line 35, after “with” and before “glass” insert -- the --.
Line 38, after “case” insert -- , --.
Line 59, after “oxide” insert -- that --.
Line 64, after “non-cohesiveness” insert -- , --.

Column 13,
Line 34, after “through” and before “similar” insert -- a --.

Column 14,
Line 10, after “with” and before “mean” insert -- a --.
Lines 32 and 62, change “amount” to -- amounts --.
Lines 34 and 63, after “layer” and before “comprised” insert -- was --.
Line 61, after “of” and before “amorphous” insert -- an --.

UNITED STATES PATENT AND TRADEMARK OFFICE

CERTIFICATE OF CORRECTION

PATENT NO. : 6,827,758 B2
DATED : December 7, 2004
INVENTOR(S) : Minoru Takaya et al.

It is certified that error appears in the above-identified patent and that said Letters Patent is hereby corrected as shown below:

Column 15,
Line 8, change “is” to -- was --.
Line 15, after “with” and before “particle” insert -- a --.
Line 27, before “electron” insert -- the --.
Line 29, after “of” and before “amorphous” insert -- an --.
Line 30, change “amount” to -- amounts --.
Line 38, change “will” to -- would -- and “mixing” to -- mixed --.

Column 16,
Line 18, after “of” insert -- an --.
Line 21, after “layer” and before “comprised” insert -- was --.
Line 28, change “compose” to -- composed --.
Line 52, change “becomes” to -- became --.

Signed and Sealed this

Sixteenth Day of May, 2006

JON W. DUDAS
*Director of the United States Patent and Trademark Office*